US005471766A

United States Patent [19]

Heikkilä et al.

[11] Patent Number: 5,471,766

[45] Date of Patent: Dec. 5, 1995

[54] METHOD IN CONTACT-FREE AIR-DRYING OF A MATERIAL WEB AS WELL AS A NOZZLE-BLOW-BOX AND A PULP DRYER THAT MAKE USE OF THE METHOD

[75] Inventors: Pertti Heikkilä, Raisio; Ilkka Jokioinen, Lieto, both of Finland

[73] Assignee: Valmet Paper Machinery, Inc., Helsinki, Finland

[21] Appl. No.: 334,210

[22] Filed: Nov. 4, 1994

Related U.S. Application Data

[63] Continuation of Ser. No. 33,380, Mar. 18, 1993, abandoned.

[51] Int. Cl.[6] ..... F26B 13/00; F26B 3/00

[52] U.S. Cl. ..... 34/461; 34/643; 34/640; 34/654

[58] Field of Search ..... 34/652, 654, 640, 34/643, 611, 618, 619, 623, 627, 629, 633, 638, 639, 647, 655, 460, 461

[56] References Cited

U.S. PATENT DOCUMENTS

| | | | |
|---|---|---|---|
| 3,272,415 | 9/1966 | Wallin | 226/97 |
| 3,837,551 | 9/1974 | Schregenberger | 34/156 |
| 3,957,187 | 5/1976 | Puigrodon | 34/156 |
| 3,979,038 | 9/1976 | Karlsson | 34/156 |
| 3,982,328 | 9/1976 | Gustafsson et al. | 34/160 |
| 4,218,001 | 8/1980 | Vits | 226/97 |
| 4,271,602 | 6/1981 | Grolms | 34/160 |
| 4,274,210 | 6/1961 | Stengard | 34/156 |
| 4,290,210 | 9/1981 | Johansson | 34/160 |
| 4,472,888 | 9/1984 | Spiller | 34/160 |
| 4,505,053 | 3/1985 | Andersson et al. | 34/155 |
| 4,719,708 | 1/1988 | Karlsson et al. | 34/156 |
| 4,837,947 | 6/1989 | Krieger | 34/156 |
| 4,893,416 | 1/1990 | Vits | 34/156 |
| 5,016,363 | 5/1991 | Krieger | 34/156 |
| 5,028,173 | 7/1991 | Vits | 34/156 |

FOREIGN PATENT DOCUMENTS

| | | |
|---|---|---|
| 0096532 | 12/1983 | European Pat. Off. . |
| 0294638 | 12/1988 | European Pat. Off. . |
| 0298299 | 1/1989 | European Pat. Off. . |
| 1143474 | 2/1960 | Germany . |
| 2802610 | 7/1979 | Germany . |
| 2146303 | 4/1985 | United Kingdom . |
| 8808950 | 11/1986 | WIPO . |

*Primary Examiner*—Denise L. Gromada
*Attorney, Agent, or Firm*—Steinberg, Raskin & Davidson

[57] ABSTRACT

The invention relates to a method for air-drying material webs, in particular material webs of relatively high grammage such as pulp webs. The invention also relates to a nozzle-blow-box and a pulp dryer that make use of the method. Air blowings in a direction substantially perpendicular to the web and air blowings in a direction substantially parallel to the plane of the web are applied to the web to be dried from underneath the web. By means of these blowings, both heat is transferred to the web and the web is supported by the air free of contact, and the run of the web through the dryer is stabilized. In order to improve the transfer of heat in comparison with a planar carrier face, the air flow velocity parallel to the plane of the web is initially kept substantially invariable. The air flow velocity is lowered in the lateral areas of the carrier face by employing lateral areas of the nozzle-carrier face that become rampwise and/or stepwise lower in the air-flow direction.

20 Claims, 6 Drawing Sheets

METHOD IN CONTACT-FREE AIR-DRYING OF A MATERIAL WEB AS WELL AS A NOZZLE-BLOW-BOX AND A PULP DRYER THAT MAKE USE OF THE METHOD

This is a continuation of application Ser. No. 08/033,380, filed Mar. 18, 1993, now abandoned.

BACKGROUND OF THE INVENTION

The invention relates to a method for air-drying material webs, in particular material webs having a relatively high grammage, such as pulp webs. In the method, air blowings are applied in a direction substantially perpendicular to the web and in a direction substantially parallel to the plane of the web to be dried from underneath the web. The air blowings cause heat to be transferred to the web, supported the web by air free of contact, and stabilize the run of the web through the dryer.

The invention also relates to a nozzle-blow-box of an air dryer through which box air blowings are applied to the material web to be dried. By means of the air blowings, both the transfer of heat is produced from the drying air to the web and a contact-free air support and stabilization of the run of the web are obtained. The nozzle-blow-box comprises a box part having a nozzle-carrier face placed against the web. A substantially V-section groove is arranged transverse to the running direction of the web in the middle of the nozzle-carrier face. The groove is opened toward the web and has opposite walls in which a series of nozzle holes are arranged. Support and stabilization air blowings can be applied out of the series of nozzle holes such that they are crosswise and of opposite directions in relation to each other. Plane nozzle-carrier-face portions are placed in the same plane with each other at both sides of the V-section groove in the nozzle-carrier face.

The invention further relates to a pulp dryer that makes use of the method of the invention and/or the nozzle-blow-box of the invention.

In prior art through-dryers used in the paper and pulp industry, blow boxes are commonly used whose nozzle-carrier face consists of a plane plate in which blow holes have been punched. These nozzles are placed either at one side or at both sides of the airborne web to be dried. The nozzle-carrier-face commonly includes a number of rows of holes, one row after the other in the running direction of the web. The blow air flows in a space between the web and the nozzle-carrier-face, and the blow air is collected away through suction slots placed between the nozzle boxes.

In the prior art direct-blow nozzle boxes of air dryers for paper, board or pulp webs, wherein the air blowings are directed perpendicularly to the material web to be dried, a well-known problem is the lateral flow of the consumed air between the web to be dried and the nozzle-carrier-face. As used in the art, the term "lateral flow" is understood as meaning air flows parallel to the plane of the carrier face and of the web. These air flows are additionally parallel or opposite to the running direction of the web. Since the air must escape from the treatment gap, a lateral flow cannot be avoided. The lateral flow deteriorates the transfer of heat in the prior art blow-nozzle boxes, and a disturbing effect is increased with an increase in the velocity of the exhaust-air flow. Further, the loss of pressure produced by the blow box is increased when the velocity increases in the lateral flow.

On the other hand, in view of the runnability of the web to be dried, it is preferable to make use of the lateral flow by shaping the blow face in the blow box and the geometry of its nozzle openings such that a zone of negative pressure is formed on the carrier face of the blow box. This zone of negative pressure stabilizes the run of the web and ensures a stable and unstrained run of the web.

With respect to the prior art most closely related to the present invention, reference is made to the Swedish Patent No. SE 8,106,152 (corresponding to U.S. Pat. No. 4,505,053) and to International Patent Application No. WO 88/08950 (corresponding to U.S. Pat. No. 5,016,363).

In the blow boxes described in the Swedish patent, triangular openings, so-called "fish eyes", have been punched into the plane nozzle-carrier-face of the blow boxes. The front edge of the openings the front edge, i.e. the base of the triangle, has sharp edges. A sharp edge is not a major drawback as long as the amount of air discharged out of the nozzle is sufficient. However, at times, the amount of air received by the nozzle may be reduced considerably from the dimensioned value, for example, if the filters for drying air are blocked. In this case, the web starts to contact the nozzle face. It has been noticed that the sharp edges plane material out of the face of, e.g., a pulp web, in which case both the quality of the finished product is deteriorated and rubbish remains in the dryer.

Moreover, the rubbish remaining in the dryer disturbs the threading of the pulp web. In this regard, the formation of a "cigar" is spoken of, for the material detached out of the face of the pulp web by planing forms a roll resembling the structure of a cigar.

In the type of nozzle-blow-boxes employed in pulp dryers in which the web runs above the nozzle and carrier faces of the boxes, the function of the air blowings is both to transfer heat from the blown air to the web and to support the Web free of contact. In view of the runnability of the web, it is preferable to blow part of the air in a direction parallel to the plane of the nozzle such that the web is stabilized at a distance of about 3 mm to about 6 mm from the carrier face. However, in such a case, in the prior art nozzle-blow-boxes, the velocity of the exhaust air in the space between the web and the nozzle becomes high. This results in deterioration of the transfer of heat and in extra and/or excessive pressure losses. The detrimental effect of the high velocity of the exhaust air can be reduced by making the nozzles sufficiently narrow, but then the number of the nozzles becomes so high that the cost of manufacture of the dryer is increased substantially.

OBJECTS AND SUMMARY OF THE INVENTION

An object of the present invention is further development of the prior art nozzle-blow-boxes described in the aforementioned patents while eliminating the drawbacks present therein.

Another object of the present invention is to provide a new and improved method and nozzle-blow-box construction by whose means it is possible to avoid the drawbacks discussed above and to improve the transfer of heat from the drying air to the airborne web to be dried. This improvement of the transfer of heat can be utilized most efficiently in the form of a smaller size being required for the dryer. In this manner, the cost of construction, e.g., of a pulp dryer, and the cost of the machine hall in which the dryer will operate can be lowered decisively, particularly the length of the building required to house the pulp dryer.

It is yet another object of the present invention to reduce the effect of the deterioration of the transfer of heat by the lateral flow while the run of the web is stabilized by means of the lateral flow.

In view of achieving these objects and others, in the method in accordance with the present invention, an air flow velocity parallel to the plane of the web to be dried and air-supported in connection with the nozzle-carrier face is initially kept substantially invariable in order to improve the transfer of heat in comparison with a plane carrier face. In this manner, the air flow velocity is lowered in the lateral areas of the carrier face by employing lateral areas of the nozzle-carrier face that become rampwise and/or stepwise lower in the air-flow direction.

The nozzle-blow-box in accordance with the invention includes nozzle-carrier face portions having extensions which comprise stepwise and/or ramp-shaped carrier-face portions placed further apart from the material web to be supported. The velocities of the support and stabilization air flows in the area of the carrier-face portions are lower as compared with the velocity prevailing in connection with the plane nozzle-carrier-face portions. The nozzle-carrier face is provided with nozzle perforations through which additional blowings can be applied from the nozzle-blow-box in a direction substantially perpendicular to the plane of the material web to be supported.

The effect of the deterioration of the transfer of heat by the lateral flow has been minimized in the present invention by lowering the lateral portions of the nozzle to a level lower than the plane middle portion such that the velocity of the lateral flow is lowered. Moreover, the lateral flows are preferably directed so that they do not directly collide with the air jets being blown directly on the plane face or on the lowered lateral portions.

The lowering of the lateral areas of the nozzle-carrier-face portions in accordance with the invention is based on the idea that a high flow velocity of the exhaust air between the web and the nozzle-carrier face causes a deterioration in the coefficient of heat transfer. Thus, the lower the space between the web and the nozzle-carrier face, the higher the velocity of the exhaust air becomes. The velocity of the exhaust air is increased in both directions from the center line of the nozzles toward the edges when more air is introduced. When the lateral areas of the nozzle-carrier-face are lowered in accordance with the present invention, the flow velocity in this area is lowered.

The nozzle-blow-box in accordance with the invention is a combination of a nozzle with positive/negative pressure in which the magnitude of the lateral flow that produces the negative pressure is selected appropriately in relation to the amount of air in the direct blowing.

It is an important feature of the hole-nozzle field in the carrier face in accordance with the invention that the coefficient of heat transfer is not substantially dependent on the distance given the relatively small nozzle-to-web distances with which the nozzles of the present invention operates. This feature is achieved, provided that the exhaust air does not disturb the air jets blown out of the nozzle holes to a significant extent. However, it is well known that, when there are several rows of nozzle holes, one row arranged after the other, the air discharged out of the nozzles generally passes toward the edges in the space between the nozzle and the web. Thus, the higher the flow velocity of the discharged air, the greater the disturbance caused to the air jets blown out of the holes and the greater the deterioration of the coefficient of heat transfer.

In a preferred embodiment of the nozzle-blow-box in accordance with the invention, air jets are directed from the walls of a V-section groove placed in the middle of the nozzle face in a direction crosswise in relation to one another at continuous rounding points between the plane carrier face placed at each side of the walls of the V-section groove. The air jets are tangential to the rounding points so that they turn and become parallel to the plane portions of the carrier face as a result of the Coanda effect. In accordance with the Bernoulli principle, a zone of negative pressure is formed between the web and the carrier faces which stabilizes the web at a certain distance from the carrier face. The distance is generally from about 3 mm to about 6 mm.

In addition, on the horizontal part of the carrier face in the present invention, attempts are made to avoid direct collisions between the jets of direct blowing and the air jets that flow in the lateral direction.

According to the present invention, the lateral areas of the nozzle-carrier face of the nozzle-blow-box have been lowered so that the velocity of the lateral flow is lowered as the cross-sectional flow area becomes larger. In this manner, the heat-transfer effect of the blow jets coming from the holes of direct blowing placed in the lowered inclined and/or straight nozzle-carrier-face portion is improved.

The nozzle-blow-box in accordance with the invention is suitable for use for drying a web both in one-sized/two-sided drying, in the case of low-grammage webs (<200 g/sq. m), and both underneath and above the web. In the case of heavy webs, such as pulp webs, the nozzle-blow-boxes in accordance with the invention are preferably suitable for lower nozzles together with direct-blow boxes that operate as upper nozzles, or alone as lower nozzle boxes in one-sided drying.

A further advantage is achieved by means of the geometry of the blow-carrier faces of the nozzle-blow-boxes in accordance with the invention. This advantage is that a smooth blow face with no sharp edges is obtained as the air of the lateral flow is introduced out of the central V-section groove while guided by rounded faces. If the web contacts the nozzle face, there are no sharp edges which will tear the web and cause a deterioration in the quality of the finished product and rubbish to remain in the dryer which will disturb the threading of the pulp web.

The transfer of heat to the web can be improved by about 5 to about 10% by means of the present invention, This improvement can be immediately taken and put to use in the form of a reduced size of the dryer which substantially lowers the cost of the investment of the dryer and the machine hall. Also, this improvement indirectly reduces the number of production interruptions and improves the operating time ratio of the dryer. The advantages mentioned above are particularly important in the case of large and complicated pulp dryers. The nature of the improvements has been quantified by measurements that have been carried out and that will be described in more detail later.

In a nozzle-blow-box in accordance with the invention, a V-section groove is used in the middle of its carrier face. Blowings parallel to the carrier face are applied crosswise through the groove. By means of this arrangement, a rigid mechanical construction is obtained in addition to a favorable blow/heat-transfer technique. The V-section groove rigidifies the nozzle carrier-face efficiently without any other rigidifying structures which would otherwise be necessary.

It is a minor drawback of the blow face of the blow box in accordance with the invention that it is somewhat more difficult to manufacture than a uniform plane face. However, this drawback can be solved by means of development of the manufacturing technology.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
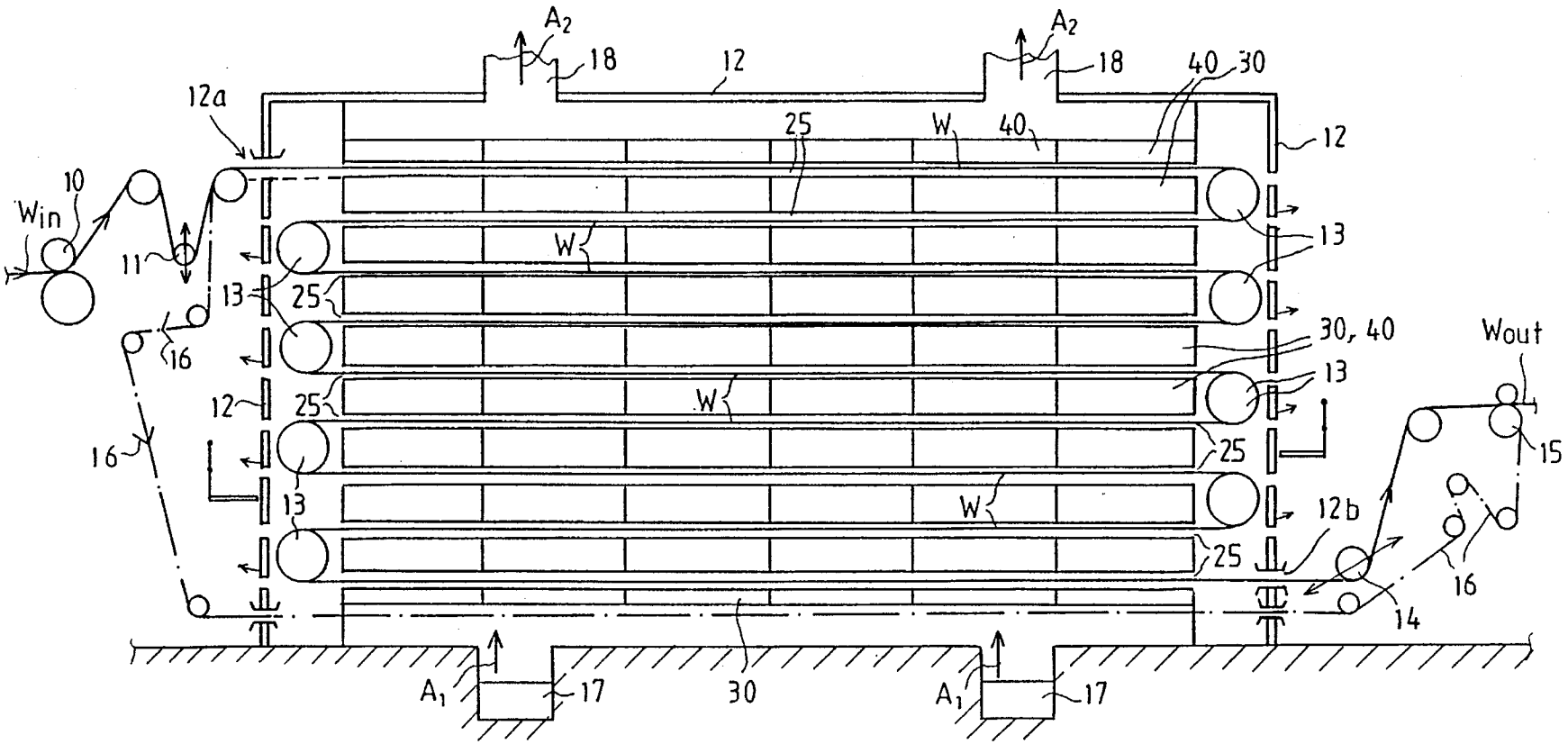
FIG. 1 is a schematic vertical sectional view in the machine direction of a pulp dryer in which the method and of a set of nozzle-blow-boxes in accordance with the invention are utilized.

FIG. 1 is a schematic vertical sectional view in the machine direction of a pulp dryer that makes use of the method and of a set of nozzle-blow-boxes in accordance with the invention. The dryer comprises a closed hood 12 having a set of nozzle-blow-boxes 30 in accordance with the invention arranged therein. A set of boxes 40 of direct blowing, i.e. arranged to blow air directly at a web W to support the web, is placed facing the set of nozzle-blow-boxes 30. The web W to be dried is passed through treatment gaps 25 formed by the sets of boxes 30,40 and is supported by air blowings from the set of boxes 30 substantially free of contact with the set of boxes 30.

The pulp web $W_{in}$, or equivalent that is passed into the dryer is passed through a wet press 10, over a roll 11 which regulates the tension of the web, and through an inlet opening 12*a*, into the hood 12. In the hood, the web W to be dried runs as horizontal draws back and forth while being guided by guide rolls 13. The dried web W is removed through an outlet opening 12*b* placed in a bottom part of the hood 12. Thereafter, the web $W_{out}$ is passed by means of an alignment roll 14 through a set of drive rolls 15 further. In FIG. 1, the path of the web threading belt or rope is illustrated by reference numeral 16 and by the dashed-dotted line.

In FIG. 1, the circulation of drying air taking place inside the hood 12 is illustrated schematically by arrows A1 . . . A2. The arrows $A_1$, and air ducts 17 through which the drying air enters into the hood, represent the introduction of replacement air from the heat recovery system. Arrows A2, and air ducts 18 through which the drying air is removed from the hood 12 represent the passage of the exhaust air to the heat recovery system.

Figure 2:
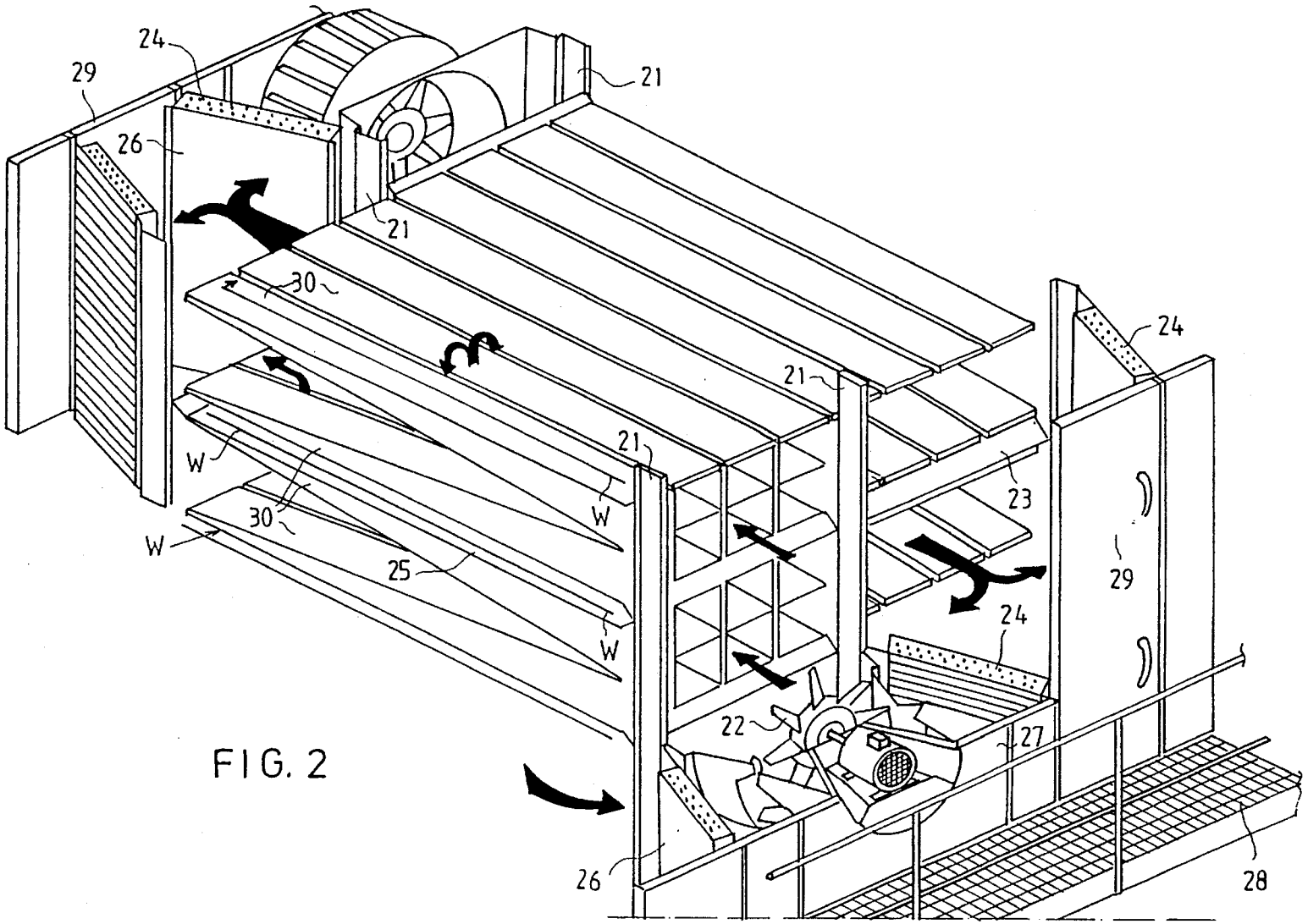
FIG. 2 is an axonometric view of the modular construction of a pulp dryer in which the method and of a set of nozzle-blow-boxes in accordance with the invention are utilized.

FIG. 2 illustrates the modular construction of a pulp dryer in which the method and nozzle-blow-box in accordance with the invention are utilized. The basic principle of the embodiment of FIG. 2 is, e.g., similar to that illustrated in FIG. 1. The dryer-blower module comprises blower towers 21 and blowers, which are provided with blade wheels 22. The module construction includes heating radiators 24 through which the blow air is passed into the gap between the upper nozzles and the lower nozzles, i.e. into web gap 25. Further, the module construction includes air filters 26. At the operating side of the blower module, a tending bridge 28 is arranged, in connection with which there are servicing gates 27 for the blower motors and servicing doors 29 for the blower modules. FIG. 2 shows the circulation of the drying air as illustrated by the arrows, and also the nozzle-blow-boxes 30,40 in accordance with the invention and the web gaps 25 between them.

With respect to the above description of FIGS. 1 and 2, it is to be emphasized that only one field of application of the method and of the set of nozzle-blow-boxes 30,40 in accordance with the invention are described therein. The method and the set of nozzle-blow-boxes 30,40 in accordance with the invention can also be applied in numerous other environments and also in devices other than pulp dryers, for example in board and paper-web dryers. However, pulp dryers are the most advantageous and primary field of application of the invention wherein several different and distinct advantages of the invention are most appropriately and completely utilized.

Figure 3:
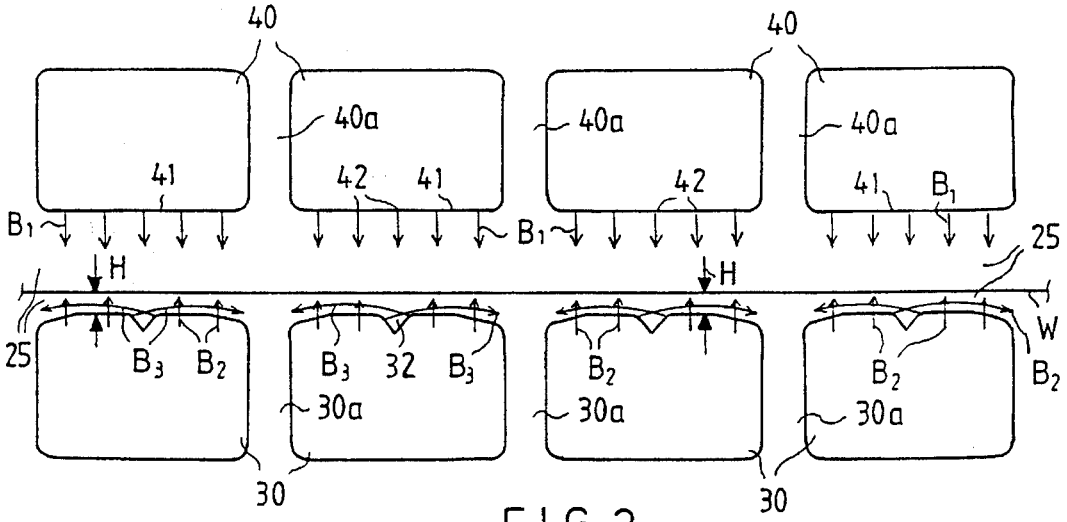
FIG. 3 is a schematic vertical sectional view in the machine direction of a set of nozzle-blow-boxes in accordance with the invention and of a set of boxes of direct blowing placed above the set of boxes.

FIG. 3 is a schematic illustration of a set of nozzle-blow-boxes 30 in accordance with the invention and of an opposite set of boxes 40 of direct blowing. In the following description, the shorter name "lower box" will be used for the nozzle-blow-boxes 30, because they are preferably placed underneath the horizontally running web W. Free spaces 30*a* are arranged between the lower boxes 30 and, in a corresponding way, free spaces 40*a* are arranged between the direct-blow boxes 40. The blow air is passed through spaces 30*a* and 40*a* further through the heating radiators 24 shown in FIG. 2 and is carried or propelled by the blower 22 back to the blow boxes.

As shown in FIG. 3, the web W to be dried, typically a pulp web, runs as a horizontal run through the web gap 25. The web gap 25 is defined as the distance between the lower boxes 30 as a lower point and the direct-blow boxes 40 as an upper point. The lower boxes 30 are preferably uniformly spaced in one horizontal plane. The direct blow-boxes 40 are also uniformly spaced in a horizontal plane. The web W, which is usually heavy (the weight of a wet pulp web may be up to about 2000 g/sq.m), is supported on the blow boxes 30 by means of the blowings $B_2$ and $B_3$. Blowings $B_1$ are applied to the web W through nozzle holes 42 placed in the horizontal lower walls of the direct-blow boxes 40 in a direction perpendicular to the plane of the web W. The web W is dried from above by means of these blowings $B_1$.

Figure 6:
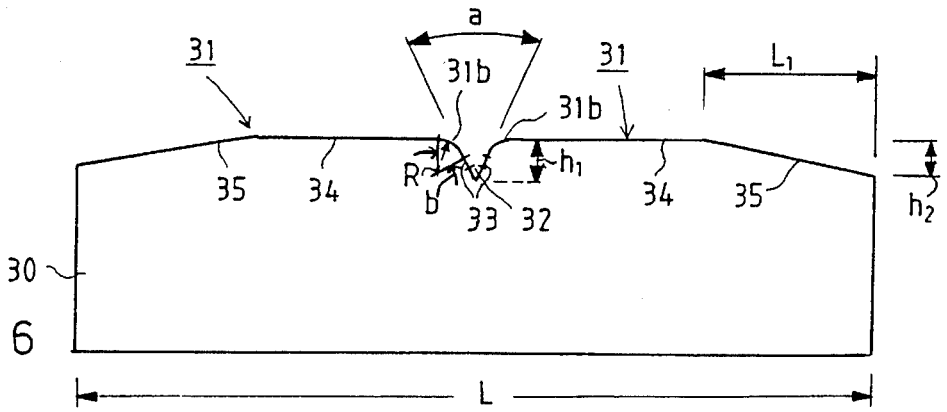
FIG. 6 shows an embodiment of a carrier face of a nozzle-blow-box in accordance with the invention and of the blow nozzles of the carrier face in more detail, together with important dimensioning parameters.

FIGS. 4, 6, and 8A and 8B illustrate the construction of the lower boxes 30 in greater detail. A transverse groove 32 is arranged in the middle portion of a carrier face 31 of the lower boxes. Groove 32 passes across the width of the web W and is opened toward the web W in preferably a V-section. The opening angle of the V-section groove 32 is denoted with a. Angle a is generally from about 50° to about 90°, preferably a is from about 60° to about 80°. The inclined walls of the V-section groove 32 are preferably plane and arranged to turn and join a horizontal plane portion 34 of the carrier face at an angle b by means of rounded portions 31*b* having a curve radius R. As shown in FIG. 6, between the angles a and b, there is a relationship a +2b=180°.

Both of the inclined plane faces of the V-section groove 32 have rows of blow holes 33. These blow holes 33 are arranged and directed so that the air jets $B_3$ are blown through the blow holes 33 in a direction tangential to the rounded portions 31*b* between the plane faces. The rounded portions turn the air jets $B_3$ by the Coanda effect onto the plane portions 34 of the carrier face 31 and make the jets parallel to the plane portions. The blow holes 33 are placed in the opposite sides of the V-section groove 32 and arranged in a staggered arrangement in relation to one another (FIG. 8) such that the blowings $B_3$ are interlocked with one another crosswise in opposite directions. Thus, one set of the blowings $B_3$ is directed parallel to the running direction of the web W and to its plane, whereas the other set of the blowings is directed parallel to the plane of the web W but in a direction opposite to the running direction of the web W.

In accordance with the Bernoulli principle, the blowings $B_3$ induce a zone of negative pressure between the web W and the carrier face 31. This zone stabilizes the web W at a certain distance H from the carrier face 31. The distance H is preferably from about 3 mm to about 6 mm, in which case the air drying of the web W is most efficient.

Lowered lateral portions 35 are placed in both of the lateral areas of the carrier face 31 over its length L in the direction of the web. The height of these lowered lateral portions 35 is lower in relation to the web W than the height of the middle-plane portions 34 of the carrier face 31. According to FIG. 6, lateral portions 35 are inclined plane bevel parts whose distance in relation to the plane parts 34 at the edges of the nozzle box 30 is denoted with $h_2$.

In the nozzle-blow-box in accordance with the invention, the air velocity is first substantially invariable in connection with the plane carrier-face portions 31 in the web W treatment gap 25 underneath the web W. The air velocity is lowered in connection with the carrier-face portions 35, 35*b*, 35*d*, 35*e* which are stepwise or continuously lowered in height when moving towards the edges of the box 30 and towards spaces 30*a* in the treatment gap 25. In this manner, the transfer of heat can be intensified considerably, as will be described later in connection with the test results illustrated in FIGS. 9 and 10. The intensification of the transfer of heat comes largely from the fact that the air-flow velocity parallel to the plane of the web W is lowered considerably on the lowered carrier-face portions 35, 35*b*, 35*d*, 35*e*. This intensifies above all the heat transfer of the direct blowings $B_2$.

Figure 4:
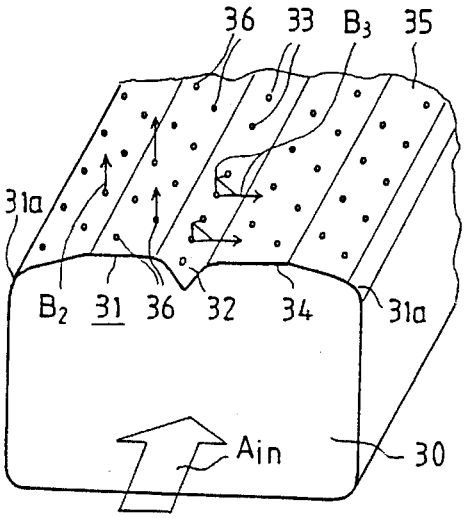
FIG. 4 is an axonometric illustration of a nozzle-blow-box in accordance with the invention and of the principle of its blowings.
Figure 5:
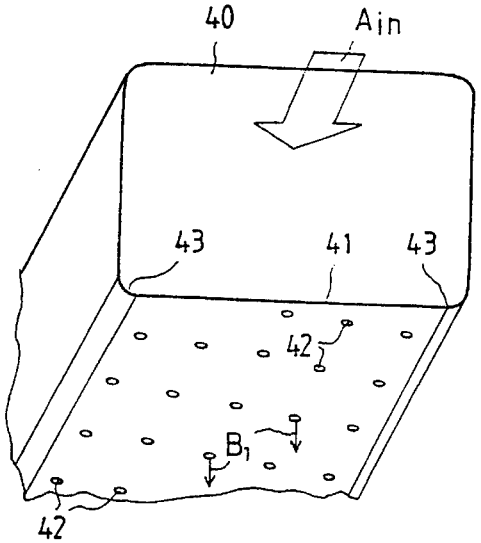
FIG. 5 is an axonometric view of the construction of an upper direct-blow box in accordance with the invention and used in a method of the present invention.

In a pulp dryer in accordance with the invention, the lower box 30 and the direct-blow box 40 as shown in FIGS. 4 and 5 are placed one above the other and one facing the other so that faces 41 and 31 of the boxes 40,30, respectively, are substantially parallel to one another and generally horizontal. Rounded portions 43*a* may be arranged at the edges of the faces 41 of the direct-blow boxes 40. Corresponding rounded portions 31*a* maybe arranged at the edges of the carrier faces 31 of the lower boxes 30.

The opposite faces 31 and 41 on the lower box 30 and on the direct-blow box 40 are provided with nozzle perforations 42,36, respectively. A preferred distribution of the perforations 36 on the blow box 30 is illustrated in FIG. 8. Perpendicular blowings $B_1$,$B_2$ are directed against the web W through the perforations 36,42 and the drying of the web W is promoted by means of these perpendicular blowings. The direct blowings $B_2$ will have a longer time of effect on the lower face of the web W as a result of the decrease in the air-flow velocity on the carrier-face portions 35 because of an increased cross-sectional flow area.

Figure 8A:
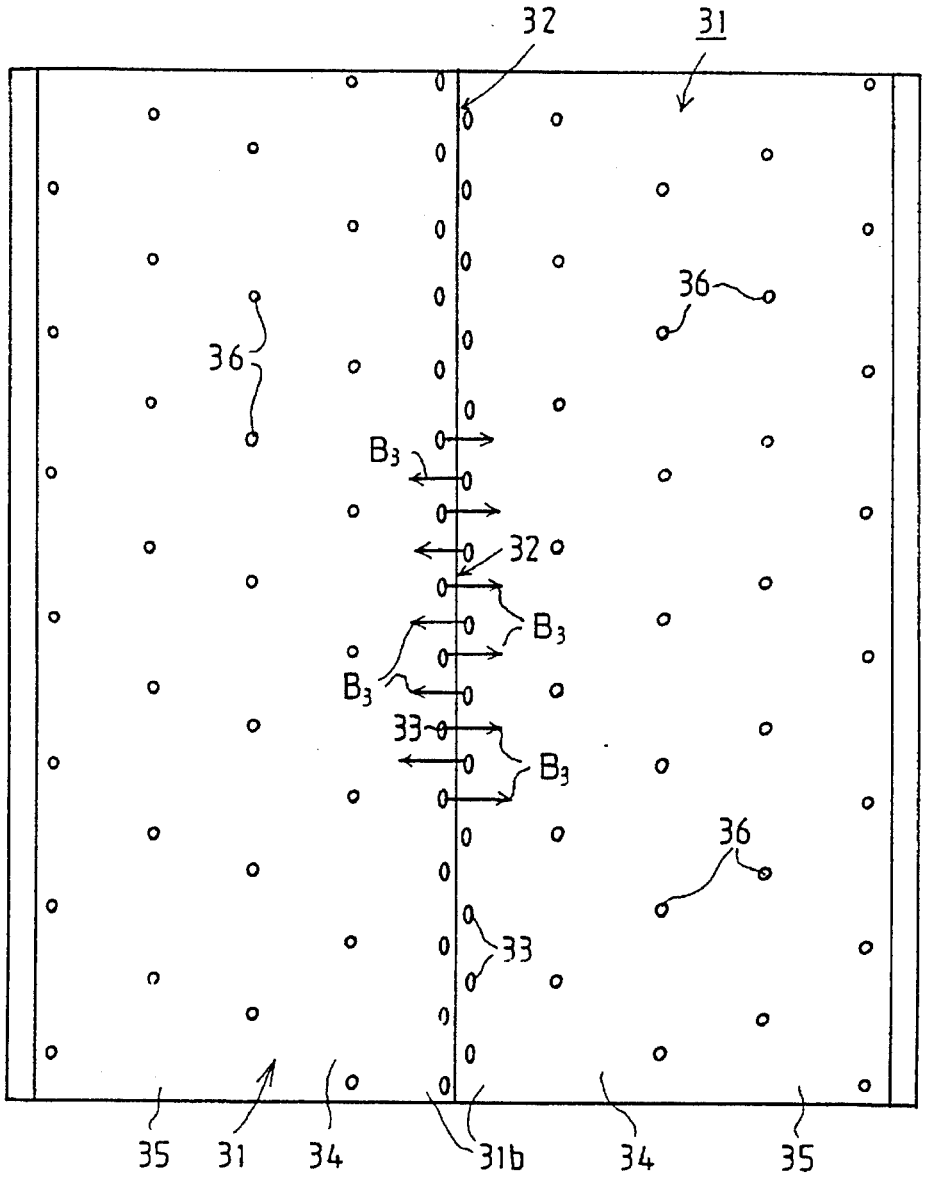
FIG. 8A shows a nozzle-blow-box as shown in FIGS. 4 or 5, viewed from a side of the nozzle-carrier face.
Figure 8B:
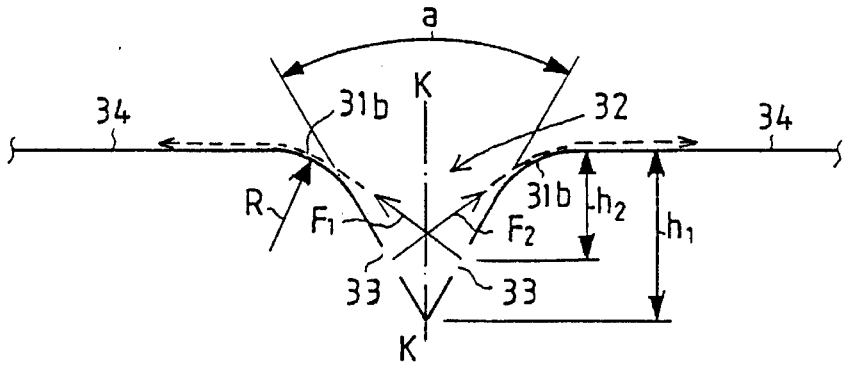
FIG. 8B is an enlarged schematic vertical sectional view in the machine direction of a preferred geometry and dimensioning of the V-section groove of the nozzle.

FIG. 8B is a schematic illustration of a preferred embodiment of the geometry and a dimensioning example of the V-section groove 32 described above. The geometry shown in FIG. 8B is symmetric in relation to a transverse vertical center plane KK. It is important in the design of the V-section groove 32 that the air jets $F_1$ and $F_2$ which are blown from the opposite sides if the groove 32 can be directed tangential to the rounded portions 31*b* connected with the edges of the groove 32. These air jets will, by the Coanda effect, turn and become parallel to the carrier face 34. The area between the groove 33 and the carrier face 34 must be specifically rounded in such a way that the air starts following the carrier face 34.

Figure 7A:
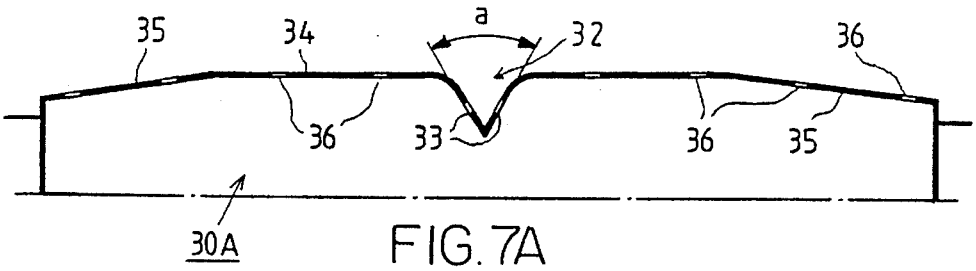
FIGS. 7A, 7B, 7C, 7D, and 7E illustrate different variations of different embodiments and dimensions of bevel and step formations of the nozzle-carrier faces of a nozzle-blow-box in accordance with the invention.

FIGS. 7A–7E show alternative embodiments of the carrier face of the blow box 30. The nozzle box 30A as shown in FIG. 7A comprises a carrier face 31 in which plane portions 34 are arranged at both sides of the V-section groove 32. Plane inclined bevel portions 35 are arranged after the plane portions 34 in the air-flow direction.

Figure 7B:
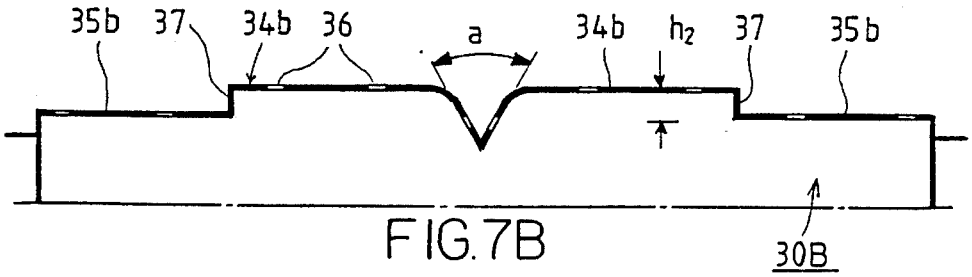

FIG. 7B shows a particularly advantageous blow box 30B, in which plane portions 34*b* of the carrier face are arranged at both sides of the V-section groove 32. Step portions 37 are arranged after the plane portions 34*b* in the air-flow direction. Step portions 37 are perpendicular both to the first plane portions 34*b* of the carrier face and to plane portions 35*b* of the carrier face that follow after the step portion 37 in the air-flow direction. The initial parts 34*b* of the carrier face 31 are preferably parallel to one another and in the same horizontal plane. In a corresponding way, the lateral portions of the carrier face 31 are preferably parallel to one another and in the same horizontal plane.

FIG. 7B also shows a preferred dimensioning example of the nozzle box 30B. According to FIG. 7B, the height $h_2$ of the step portion 37 is about 10 mm. Generally, the height of the step portion $h_2$ may vary from about 7 mm to about 15 mm.

Figure 7C:
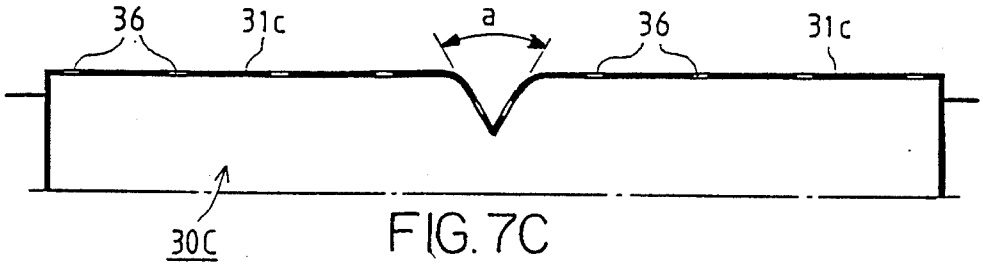
Figure 9:
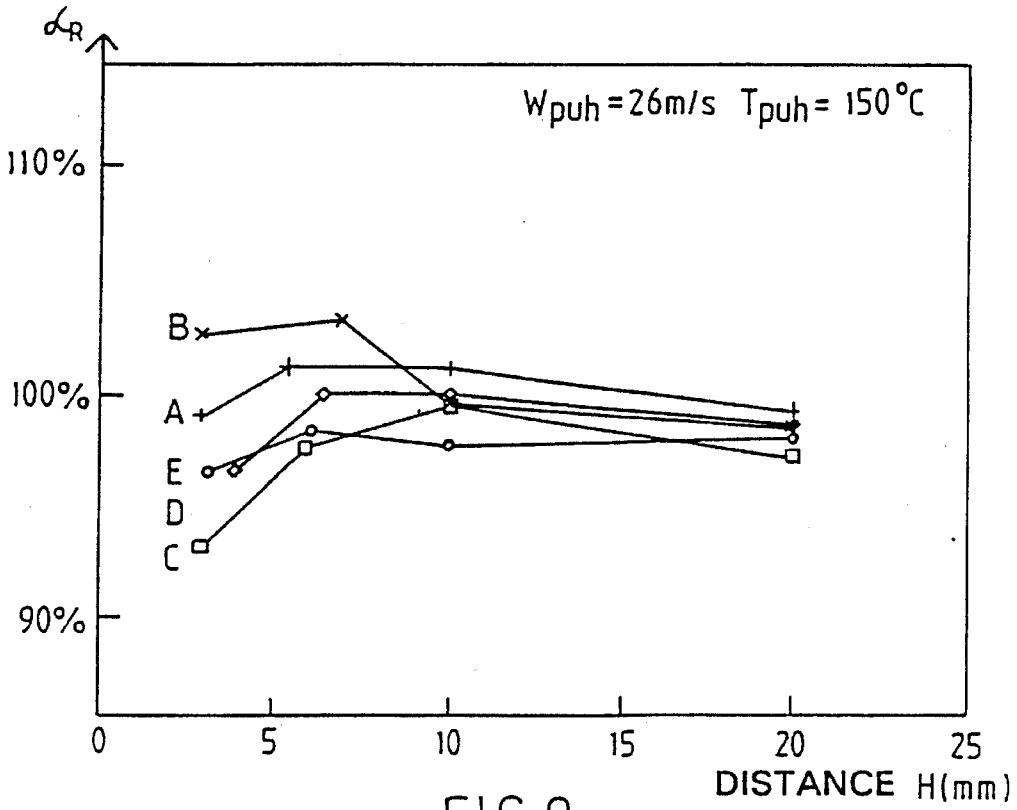
FIG. 9 illustrates different relative coefficients of heat transfer of the embodiments illustrated in FIGS. 7A to 7E as a function of the distance of the web at a first air-blow velocity.
Figure 10:
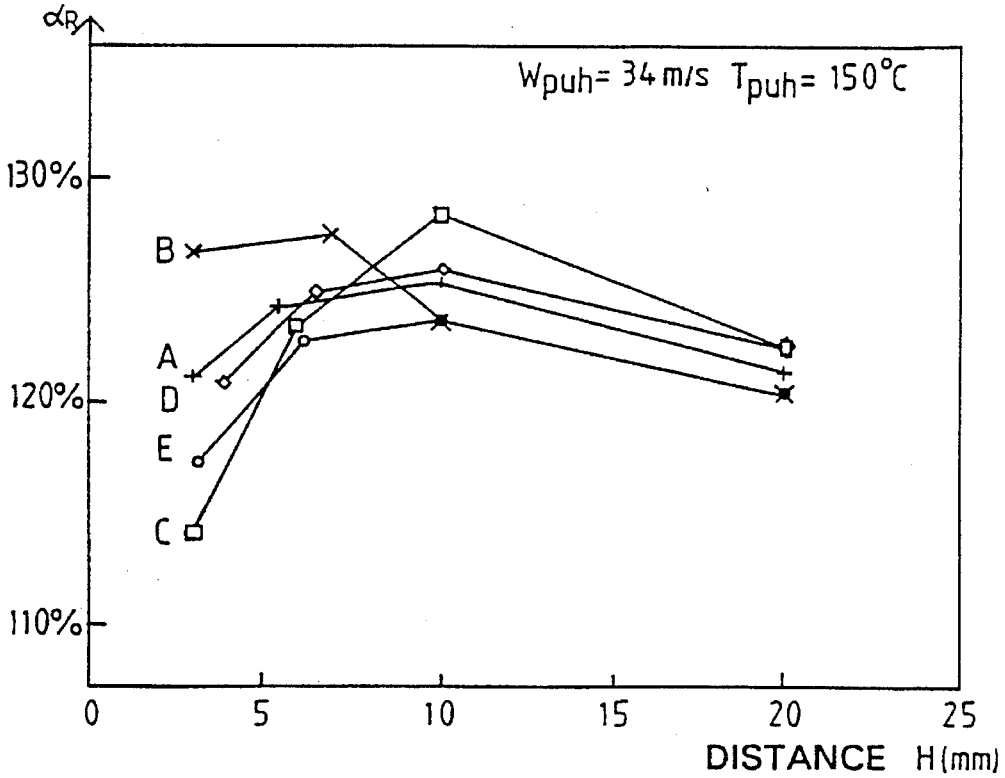
FIG. 10 illustrates the corresponding measurement results in a manner corresponding to FIG. 9, at a second, higher air-blow velocity.

In FIG. 7C, a nozzle box 30C is illustrated as a reference, which box has a fully plane carrier face 31*c*. Properly speaking, this nozzle box 30C is not a preferred embodiment in accordance with the present invention, and it is illustrated in this connection for the sake of reference only. The results of a comparison including this reference nozzle box are illustrated in FIGS. 9 and 10, which will be described in more detail later.

Figure 7D:
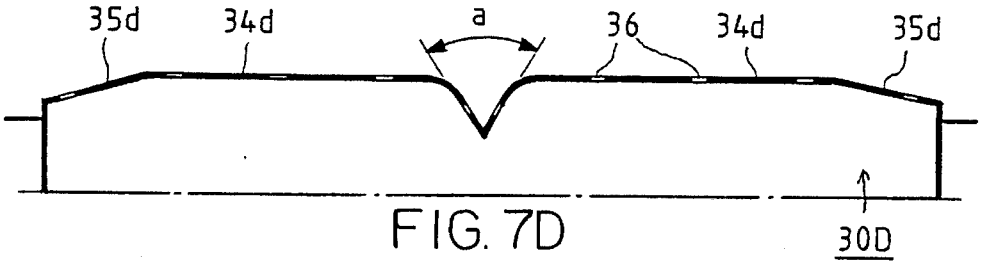

FIG. 7D illustrates a blow box 30D in accordance with the invention, which box has relatively long plane carrier-face portions 34*d* and relatively short and steep, inclined lateral portions 35*d*. In FIG. 7D, a preferred dimensioning example is also provided.

Figure 7E:
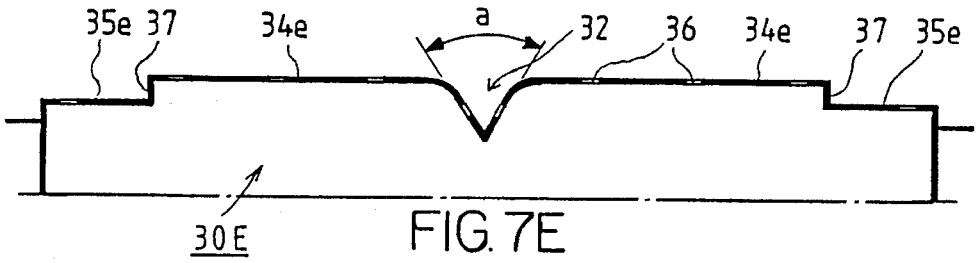

In FIG. 7E, an alternative modification of the blow box as shown in FIG. 7B is illustrated. Blow box 30E has relatively long plane carrier-face portions 34*e* and step portions 37 which are followed by relatively short carrier-face portions 35*e* in the air-flow direction. FIG. 7E also shows an example of the construction of blow box 30E.

FIG. 8A shows the relative locations and staggering of the nozzle holes 33 in the V-section groove 32 so that the blowings $B_3$ being blown in opposite directions are blown crosswise. The perforations 36 in the nozzle-carrier face 31 are placed in four lines or rows, one line after the other, as staggered in such a way that the blowings $B_2$ and $B_3$ neither meet each other nor disturb each other. The mutual spacing of the nozzle holes 33 is generally from about 20 mm to about 50 mm. In a corresponding way, the mutual spacing of the nozzle holes 36 in the transverse direction and in the machine direction is usually from about 40 mm to about 100 mm.

Further, as to the dimensioning of the blow boxes shown in FIGS. 6 and 7, it can be stated as follows, with reference to the denotations in FIG. 6. The angle a of the V-section groove 32 in the middle of the carrier face is generally from about 50° to about 90°, in which case the angle b of the Coanda faces 31*b* is from about 45° to about 65°. The height $h_1$ of the V-section groove 32 is optimally obtained from the equation $h_1=(2–5)\times\phi$ wherein $\phi$ is the diameter of the nozzle holes 33 in the walls of the V—section groove 32. The diameter $\phi$ of the nozzle holes 33 is selected relative to the diameter of the direct-blow nozzles 36 in the carrier face so that the air quantity in the carrier-blowings $B_3$ blown through the nozzle holes 33 is about 30% to about 60%, preferably 35% to about 45%, of the overall air quantity of the blowings $B_2$ and $B_3$.

The length $L_1$ of the bevelled or step-formed lateral portions 35,35*b*,35*d*,35*e* in the carrier face 31 is selected according to the equation $L_1=(0.1–0.3)\times L$, preferably $L_1=(0.2–0.25)\times L$, wherein L is the total length of the blow box 30 in the machine direction. Generally, length L is from about 300 mm to about 500 mm. The difference in height $h_2$ of the bevelled portions 35,35*d* or of the step-formed portions 35*b* and 35*e* is selected from about 7 mm to about 15 mm, preferably $h_2$ is about 10 mm.

FIGS. 9 and 10 graphically illustrate test results obtained with nozzles as shown in FIGS. 7A–7E. In FIGS. 9 and 10, the vertical axis represents the relative heat transfer coefficient $\alpha_R$ and the horizontal axis represents the distance of the web W from the carrier face 31, expressly from its plane portion 34. In FIGS. 7A–7E, the letter symbol after the numeral "7" corresponds to the curves A–E in FIGS. 9 and 10.

Of the nozzle arrangement described above, versions as shown in FIGS. 7A–7E were made and the transfer of heat was examined in a static test device by blowing hot air against a plane metal face. The efficiency of the transfer of heat was obtained by measuring the heating rate of the plate by means of temperature-measurement detectors inlaid in the plate.

In FIGS. 9 and 10, the measured relative heat-transfer coefficients $\alpha_R$ are illustrated as a function of the distance H between tile web and the carrier face 31 of the nozzle box at two different blow velocities. According to the results, a lowering $h_1$ of the lateral portions 35,35*b*,35*d*,35*e* provides an increase in the range of about 5% to about 10% in the coefficient of heat transfer as compared with a plane carrier face (FIG. 7C, carrier face 31*c*), when the distance H equals the normal airborne distance of a pulp web W (between about 3 mm and 6 mm). In contrast, at larger distances H, a lowering or decrease of the lateral portions 35 does not give any corresponding advantage. The increase was highest in the case of the nozzles at which the lateral portions 35,35*b* of the carrier face 31 had been lowered most, on the average (FIGS. 7A and 7B). The measurement results provided in FIG. 9 were obtained with a blow velocity of $w_{puh}$ is about 26 m/s of the blowings $B_2$ and $B_3$. The results given in FIG. 10 were obtained with a corresponding blow velocity of $w_{puh}$ is about 34 m/s, while the temperature $T_{puh}$ of the blow air was about 150° C. As shown in FIGS. 9 and 10, there are substantially large differences in the relative heat-transfer coefficient $\alpha_R$ exactly at the optimal airborne web W distances, i.e. when H is between 3 mm and 6 mm.

The simulation and measurement method employed in the measurements of FIGS. 9 and 10 has been described in more detail in a paper by P. Heikkila and I. Jokioinen, "Airfoil Dryer Heat Transfer", published in The Helsinki Symposium on Alternate Methods of Pulp and Paper Drying in Helsinki, Jun. 4–7 (1991).

Based on the measurements described above, the most advantageous embodiment of the invention is, according to the present-day opinion and on the basis of the available measurement results, the blow-nozzle box 30A as shown in FIG. 7A. According to the measurement results of FIGS. 9 and 10, a carrier face 34*b*,35*b* with a steep step formation 37, as shown in FIG. 7B, is optimal in view of the transfer of heat. However, a nozzle-blow-box 30A as shown in FIG. 7A, which is provided with continuously lowering ramp-formed lateral portions 35 of the carrier face, is preferable in an overall consideration because the risk of formation of a "cigar" is lower for this nozzle-blow-box 30A as the geometry of the blow face does not include sharp angles. Thus, according to a present-day estimate, a nozzle-blow-box 30A as shown in FIG. 7A (also in respect of its dimensions) is the most preferable embodiment of the invention in a situation in which the distance, e.g., of a pulp web W from the horizontal portion 34 of the carrier face 31 is about 5 mm.

The examples provided above are not meant to be exclusive. Many other variations of the present invention would be obvious to those skilled in the art, and are contemplated to be within the scope of the appended claims.

We claim:

1. A method for air-drying material webs in a dryer, comprising arranging nozzle-blow-boxes on one side of a web such that a top side of said nozzle-blow-boxes forms a planar carrier face, arranging a groove in a middle portion of said carrier face and extending in a direction transverse to a running direction of the web, directing first air blowings to a web to be dried through first nozzle means in said carrier face in a direction substantially perpendicular to the web, directing second air blowings to the web crosswise through second nozzle means in opposing walls of said groove and in a direction substantially parallel to the web, said first and second air blowings transferring heat to the web and supporting the web by air such that a run of the web through a dryer is stabilized, maintaining an initial velocity of said second air blowings to be substantially constant to improve the transfer of heat in comparison with said carrier face, and arranging lateral areas of said carrier face to become lower in the flow direction of said second air blowings to lower the velocity of said second air blowings in said lateral areas of said carrier face and increase the cross-sectional flow area between the web and said carrier face in said lateral areas thereof such that the time of effect of said second air blowings upon a lower face of the web is increased.

2. The method of claim 1, further comprising optimizing the transfer of heat from said first and second air blowings to the web by means of said lateral areas of said carrier face and regulating the height at which the web runs and is supported in relation to said carrier face by means of said lateral areas of said carrier face.

3. The method of claim 1, wherein said second nozzle means comprise nozzle openings arranged in said groove in said carrier face, said second air blowings being directed crosswise from said nozzle openings in opposite directions and substantially tangential to curved guide faces arranged in said carrier face, said second air blowings being turned by the Coanda effect to become parallel to plane initial parts of said carrier face and a plane of the web.

4. The method of claim 1, further comprising providing that the blow-air quantity of said second air blowings is between about 30% to about 60% of the overall blow-air quantity of said nozzle-blow-boxes.

5. The method of claim 4, wherein the blow-air quantity of said second air blowings is between about 35% to about 45% of the overall blow-air quantity of said nozzle-blow-boxes.

6. The method of claim 1, further comprising decreasing the velocity of said second air blowings in said lateral areas of said carrier face of said nozzle box over a length $L_1$ parallel to the run of the web, length $L_1$ being computed from the equation $L_1=L\times(0.1–0.3)$ wherein L is the overall length of said carrier face of said nozzle box selected from about 300 mm to about 500 mm.

7. The method of claim 6, wherein the length $L_1$ parallel to the run of the web is computed from the equation $L_1=L\times(0.2–0.25)$.

8. The method of claim 1, further comprising arranging a plurality of nozzle boxes having spaces formed therebetween, and removing air out of a drying and support gap defined between said carrier face and the web through said spaces.

9. The method of claim 1, further comprising arranging direct-blow boxes on a side of the web opposite said nozzle-blow-boxes, and directing third air blowings out of said direct-blow boxes in a direction substantially perpendicular to the plane of the web such that both sides of the web are dried.

10. A nozzle-blow-box of an air dryer for directing air blowings to a material web to be dried, the air blowings producing a transfer of heat from the drying air to the web and contact-free air support and stabilization of a run of the web through the air dryer, said nozzle-blow-box comprising a box part having a nozzle-carrier face arranged to face the web, a substantially V-section groove arranged in a middle portion of said nozzle-carrier face and extending in a direction transverse to a running direction of the web, said groove being open toward the web and having a series of nozzle holes arranged in opposite walls for directing support and stabilization air blowings to the web, said support and stabilization air blowings being directed crosswise and in opposite directions in relation to each other, said nozzle-carrier face comprising planar nozzle-carrier faces arranged on both sides of said groove and in the same plane with each other, said planar nozzle-carrier faces having extensions comprising lateral carrier face portions arranged further apart from the web, the velocity of said support and stabilization air blowings being lower in proximity to said lateral carrier-face portions as compared with the velocity of said support and stabilization air blowings prevailing in proximity to said planar nozzle-carrier-face portions, said nozzle-carrier face further comprising nozzle perforations through which additional air blowings are directed from said nozzle-blow-box in a direction substantially perpendicular to the plane of the web.

11. The nozzle-blow-box of claim 10, wherein said groove has extensions on said opposite walls of said groove, said extensions comprising curved Coanda guide faces which extend continuously and connect to said planar nozzle-carrier-face portions, said series of nozzle holes being arranged to direct said support and stabilization air blowings in a direction substantially tangential to said curved Coanda guide face on an opposing wall.

12. The nozzle-blow-box of claim 10, wherein an angle between said opposite walls of said groove is from about 50° to about 90°, and the depth $h_1$ of said groove is computed from the equation $h_1=(2–5)\times\phi$, wherein $\phi$ is the diameter of said series of nozzle holes in said walls of said groove.

13. The nozzle-blow-box of claim 10, wherein the length $L_1$ of said lateral carrier face portions in the running direction of the web is computed from the equation $L_1=(0.1–0.3)\times L$, wherein L is the overall length of said nozzle-blow-box in the running direction of the web and is from about 300 mm to about 500 mm, and the maximum difference in height of said lateral carrier face portions, as compared with said planar nozzle-carrier-face portions, is from about 7 mm to about 15 mm.

14. The nozzle-blow-box of claim 13, wherein the length $L_1$ of said lateral carrier face portions is computed from the equation $L_1=(0.2–0.25)\times L$, and the maximum difference in height of said lateral carrier face portions, as compared with said planar nozzle-carrier-face portions, is about 10 mm.

15. The nozzle-blow-box of claim 10, wherein said series of nozzle holes are arranged in an alternating staggered arrangement and substantially uniformly spaced in said groove, the spacing of said series of nozzle holes being selected from about 20 mm to about 50 mm, said nozzle perforations being arranged in a staggered arrangement in relation to said series of nozzle holes, between 3 and 5 transverse rows in the running direction of the web and substantially uniformly spaced both in the running direction of the web and in the transverse direction, the spacing of said nozzle perforations being selected from about 40 mm to about 100 mm.

16. The nozzle-blow-box of claim 10, wherein said lateral carrier face portions are ramp-shaped.

17. The nozzle-blow-box of claim 10, wherein said lateral carrier face portions are stepwise.

18. A pulp dryer for drying material webs, comprising nozzle-blow-boxes arranged at horizontal distances from one another to form spaces therebetween, said nozzle-blow boxes being placed at a distance from a material web to form treatment gaps, a first set of said nozzle-blow-boxes comprising means for directing air through a nozzle carrier face of said nozzle-blow-boxes in both a perpendicular direction to the web and in a parallel direction to the web to support, dry and stabilize the web, said means comprising a groove arranged in said nozzle carrier face and extending in a direction transverse to a running direction of the web, said groove being open toward the web and having a series of nozzle holes arranged in opposite walls for directing air in the direction parallel to the web crosswise and in opposite directions in relation to each other, said means further comprising nozzle means for directing air in the direction perpendicular to the web, the air being removed from said treatment gaps via said spaces, said nozzle-blow-boxes being arranged in the running direction of the web one after another in a horizontal plane such that rows of said nozzle-blow-boxes are formed in the dryer, a hood through which the web to be dried runs through the dryer supported by air, the web being arranged to run over said rows of said first set of said nozzle-blow-boxes in horizontal backward and forward runs arranged in a vertical orientation in the dryer, and reversing rolls for reversing the running direction of the web between said horizontal runs.

19. The pulp dryer of claim 18, further comprising a second set of said nozzle-blow boxes constituting direct-blow boxes arranged opposite said first set of said nozzle-blow-boxes and above the web, said direct-blow boxes directing blowings in the direction substantially perpendicular to the web through nozzle perforations arranged in a planar face of said direct-blow boxes, said direct-blow boxes being arranged to form intermediate spaces therebetween through which said air blowings from said direct-blow boxes flow.

20. The pulp dryer of claim 19, wherein the length of said first set of said nozzle-blow-boxes and said direct-blow boxes is substantially equal, and said first set of said nozzle-blow-boxes are arranged in a uniformly spaced arrangement in the dryer to face said direct-blow boxes.

* * * * *